US005673497A

United States Patent [19]

St. Louis

[11] Patent Number: 5,673,497

[45] Date of Patent: Oct. 7, 1997

[54] CLOTHES DRYER TEMPERATURE CONTROL SYSTEM

[76] Inventor: Robert St. Louis, 8980 Rochette, St. Leonard, Quebec H1P 2K2, Canada

[21] Appl. No.: 722,618

[22] Filed: Sep. 27, 1996

[30] Foreign Application Priority Data

Sep. 12, 1996 [CA] Canada ..... 2185382

[51] Int. Cl.[6] ..... F26B 3/00

[52] U.S. Cl. ..... 34/486; 34/491; 34/549; 34/553; 34/562

[58] Field of Search ..... 34/549, 550, 551, 34/552, 553, 554, 555, 493, 496, 497, 487, 486, 543, 562, 565

[56] References Cited

U.S. PATENT DOCUMENTS 3,116,983 1/1964 Chafee, Jr. .
3,318,016 5/1967 Chafee, Jr. .
3,322,415 5/1967 Lux .
3,409,994 11/1968 Menk .
4,642,907 2/1987 Rest .
4,842,192 6/1989 Range et al. .
5,443,541 8/1995 St. Louis .

*Primary Examiner*—Henry A. Bennett
*Assistant Examiner*—Dinnata Doster

[57] ABSTRACT

A clothes dryer temperature control system or circuit is provided with a thermally biased thermostat adjacent to the air outlet of the drying drum. Further, a thermally biased control thermostat is provided adjacent the air inlet of the dryer drum. The two thermostats are controlled through a multiple contact switch controller which allows the dryer to operate in a high heat, medium heat, low heat, and damp dry heating cycles. Additionally, in a gas dryer embodiment a trimmer thermostat is located in circuit with the thermally biased resistor of the thermally biased air inlet thermostat so as to decrease the response time of this thermostat on its first cycle to prevent damage to clothing during initial operation of a gas dryer.

12 Claims, 11 Drawing Sheets

CLOTHES DRYER TEMPERATURE CONTROL SYSTEM

BACKGROUND OF THE INVENTION

The present invention relates to an automatic clothes dryer and in particular to an electric control circuit for use during a clothes drying cycle which provides thermal bias to the operating thermostats used in the dryer circuitry.

Clothes dryers are known to employ an operating thermostat which senses the exhaust air temperature from the dryer during the drying cycle. Small heating elements are placed adjacent the thermostat to provide a thermal bias. The provision of a thermal bias causes the thermostat to operate at a lower exhaust air temperature and is commonly used to lower the maximum exhaust air temperature at which the operating thermostat reacts thereby cycling a main heater.

The use of operating thermostats located at the air inlet for a gas dryer is taught by U.S. Pat. No. 3,322,415 issued May 30, 1967 to Joseph P. Lux.

The use of a bias thermostat to effect the operation of the operating thermostat relative to changes in ambient temperature is disclosed in U.S. Pat. No. 3,318,016 issued May 9, 1967 to Glen R. Chafee, Jr. A similar circuit is also disclosed in U.S. Pat. No. 3,116,983 issued to G. R. Chafee, Jr. on Jan. 7, 1964.

U.S. Pat. No. 3,409,994 issued Nov. 12, 1968 to Melvin A. Menk teaches a thermally biased thermostat located in the output exhaust path of the dryer drum outlet side. Such a circuit is also shown and disclosed in U.S. Pat. No. 4,842, 192 issued Jun. 27, 1989 to Range et al where a bias thermostat is provided on the dryer drum outlet side.

U.S. Pat. No. 5,443,541 issued to me on Aug. 22, 1995 teaches electric clothes dryer having two coils selectively operable by various thermostats to control partial heating of the air entering the dryer drum.

While the use of thermally biased thermostats is known in the art, there has been no use of a thermally biased thermostat to sense the temperature of the air stream, upstream from the dryer drum (clothes container). These thermostats have been associated with the air stream, down stream from the drum.

SUMMARY OF THE INVENTION

The present invention is directed towards a novel use of a thermally biased control thermostat adjacent the air inlet of a dryer drum. By utilizing a thermally biased thermostat at the inlet, it is possible to provide dryer heating cycles which operate at below maximum heating conditions.

There is also provided a thermally biased thermostat at the air inlet of the dryer drum which has a decreased cycle response time on the first cycle of dryer operation by using a trimmer thermostat to effectively energize the bias resistor to bias (reduce) the temperature at which the inlet thermostat will open circuit the heating device. This is particularly useful for use in operation with dryers where the dryer heats up quickly during the first cycle and when there may be an air blockage or heavy load in the clothes dryer. In particular, the use of the trimmer thermostat has advantage in gas appliances.

In accordance with one aspect of the present invention there is provided a control circuit for operating a clothes dryer having a dryer drum, a drum air inlet and a drum air outlet permitting an air stream to pass through the dryer drum and a heating device for heating the air stream before the air stream passes through the dryer drum. The control circuit comprises a first thermally biased thermostat mounted to the dryer adjacent the drum air inlet and electrically connected in series with the heating device. The first thermally biased thermostat is responsive to temperature of the air stream, prior to the air stream passing through the dryer drum to move between open and closed positions for controlling corresponding heating and non-heating operation of the heating device. The thermally biased thermostat includes a first heat biasing resistor which when energized alters thermal response of the first thermally biased thermostat. A switch temperature controller is mounted to the dryer for controlling operation of the dryer. The switch temperature controller has at least one dryer operation position corresponding to a heat setting below maximum heating that initiates and maintains the heating operation of the heating device. This causes electricity to flow through a circuit path that energizes the first heat biasing resistor of the thermostat. The first heat biasing resistor continually heats the first thermally biased thermostat to reduce the temperature below a maximum temperature setting at which the first thermally biased thermostat cycles on and off to reduce the temperature of the air stream entering the dryer drum through the dryer air inlet.

In accordance with another aspect of the present invention, there is provided a control circuit for operating a clothes dryer having a dryer drum, a drum air inlet and a drum air outlet permitting an air stream to pass through the dryer drum, and a heating device for heating the air stream before the air stream passes through the dryer drum. The control circuit comprises a first thermally biased thermostat mounted to the dryer between the heating device and the dryer drum air inlet and electrically connected in series with a heating device. The first thermally biased thermostat is responsive to temperature of the air stream prior to the air stream passing through the dryer drum to move between open and closed positions for controlling the corresponding heating and non-heating operation of the heating device. The thermally biased thermostat includes a first heat biasing resistor which when energized alters the thermal response of the first thermally biased thermostat. The control circuit further includes a trimmer thermostat mounted in the air stream downstream of and adjacent the heating device. The trimmer thermostat is electrically connected in series with the first heat biasing resistor. The trimmer thermostat is responsive to the temperature of the air stream flowing through the heating device to move between an initially closed position enabling electrical energization of the first heat biasing resistor and an open position inhibiting electrical energization of the first heat biasing resistor. The control circuit further includes a switch temperature controller mounted to the dryer for controlling operation of the dryer. The switch temperature controller has at least one dryer start up position that initiates the heating operation of the heating device and causes electricity to flow through the circuit path including the trimmer thermostat. This electrically energizes the first heat biasing resistor and causes the first heat biasing resistor to pre-heat the first thermostat prior to the air stream being overly heated to thereby reduce first cycle response time of the first thermally biased thermostat.

BRIEF DESCRIPTION OF THE DRAWINGS

For a better understanding of the nature and objects of the present invention reference may be had to the accompanying diagrammatic drawings in which.

DESCRIPTION OF THE PREFERRED EMBODIMENT

Figure 1:
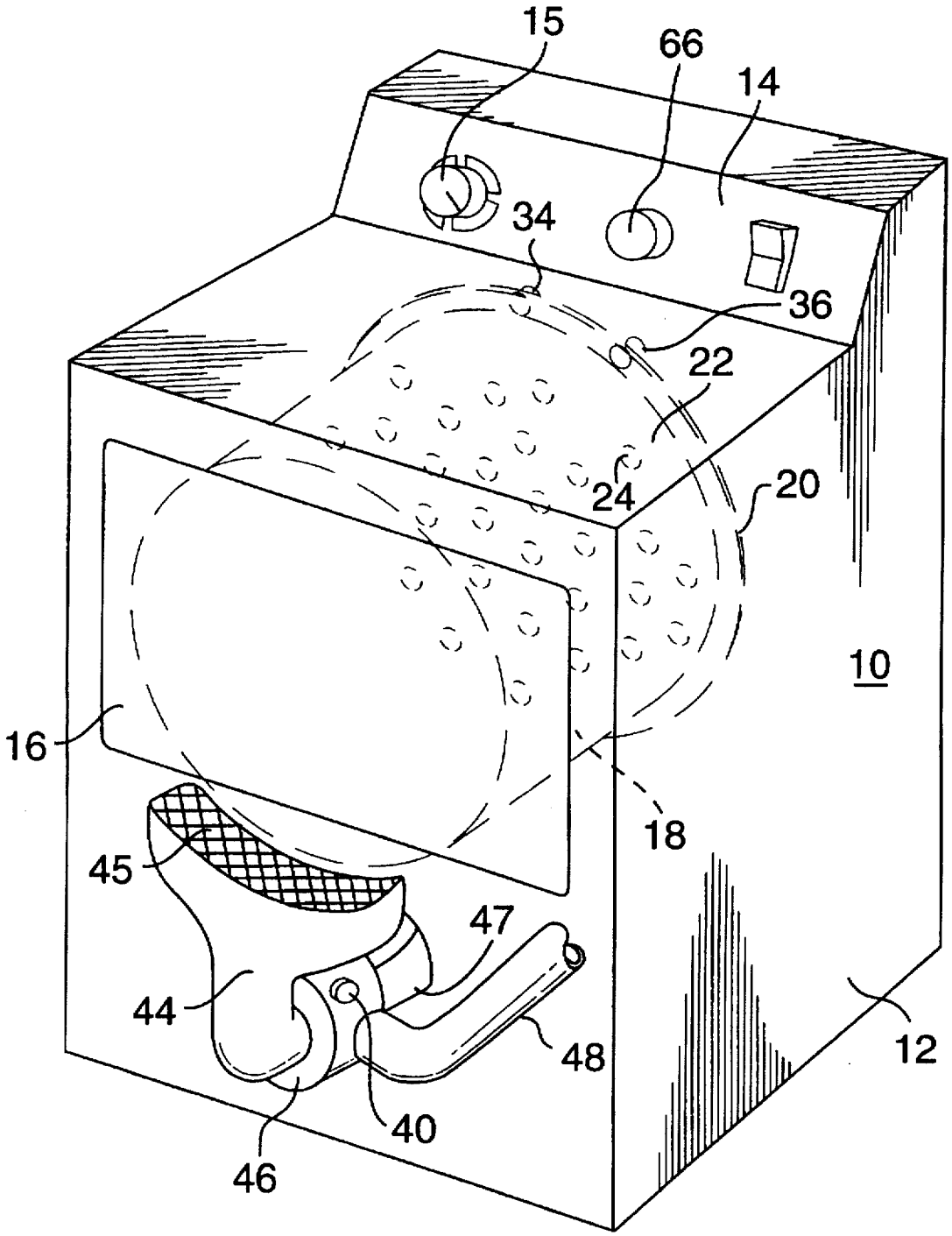
FIG. 1 is a partial perspective of a clothes dryer of this invention.
Figure 2:
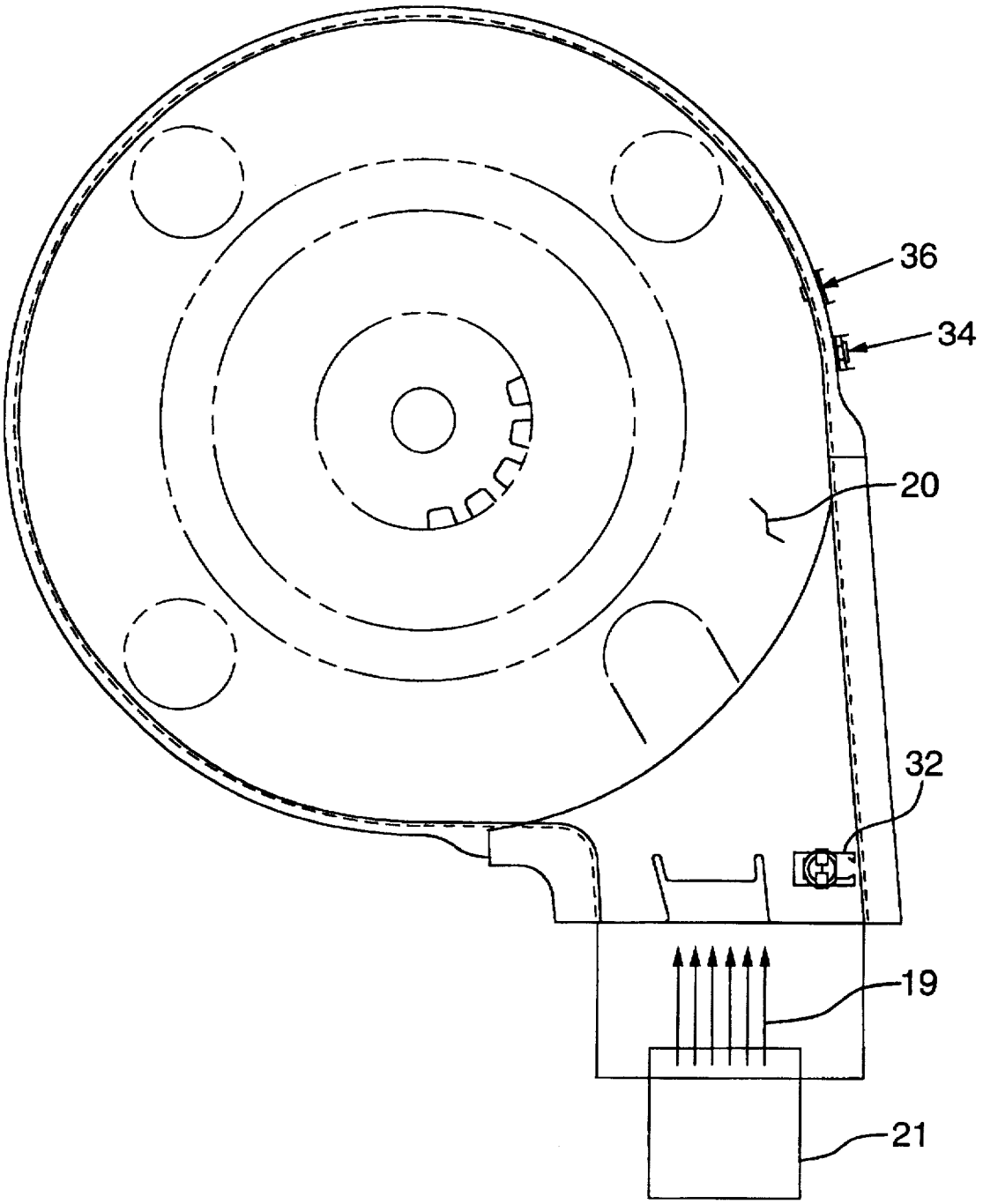
FIG. 2 is a view of the diffuser for a gas dryer used in the dryer of FIG. 1.
Figure 3:
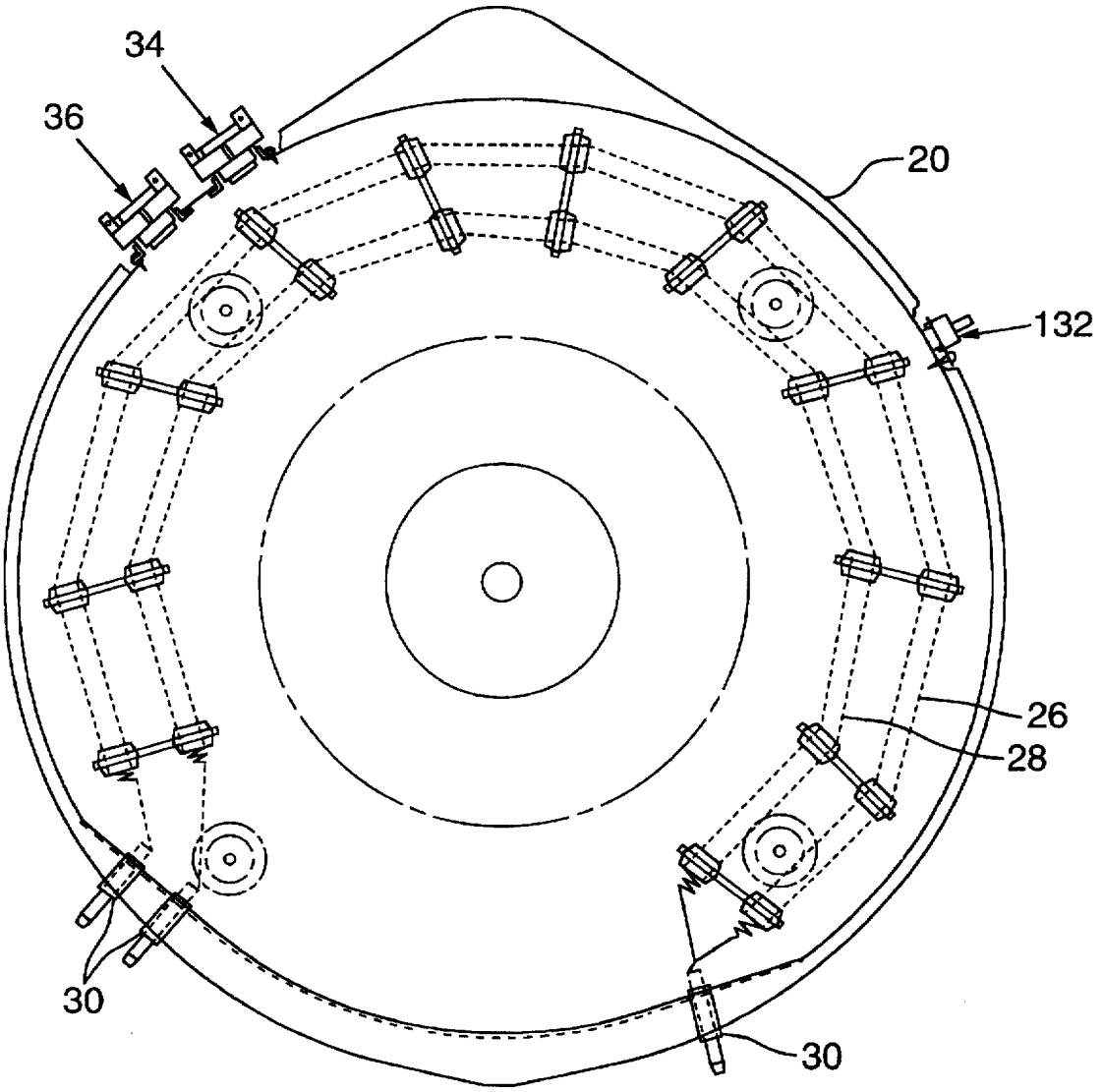
FIG. 3 is a view of the diffuser for an electric dryer showing the heating devices for the dryer of FIG. 1.

Referring to FIGS. 1 to 3 a domestic clothes dryer 10 is shown. FIG. 2 shows a gas dryer diffuser whereas FIG. 3 shows an electric dryer diffuser, both numbered 20.

Dryer 10 has a cabinet or housing 12 on which is mounted a control panel 14 having a selector switch 15 which allows the user to select various drying modes and degrees of dryness of the clothes undergoing drying. The control panel 14 is also provided with a start switch 66. Cabinet 12 has a door 16 mounted on the front panel to allow access to clothes in the drum or clothes container 18. Drum 18 is mounted in cabinet 12 so as to allow for rotation therein.

Drum 18 is mounted within the cabinet 12 so that the rear of the drum 18 is substantially surrounded by a diffuser 20, shown in more detail in FIGS. 2 and 3. The drum 18 is provided with a flat disc shaped member 22 at the rear thereof which contains a plurality of apertures such as 24, providing an air inlet for the drum for the passage of drying air therethrough.

Referring to FIG. 2, the diffuser 20 is shown for a gas dryer. Air entering the diffuser 20 of FIG. 2 is heated by a gas flame in a burner 21 located in the air stream prior to entering the diffuser 20. The diffuser circulates the heated air stream about the rear surface of the dryer drum so that the air enters the drum air inlet relatively evenly. An additional thermostat 32, referred to as a trimmer thermostat is located downstream of the air flow (indicated by arrows 19) from burner 21. The purpose of this trimmer thermostat is described in more detail with the description of the circuit of FIGS. 4 to 7.

Referring to FIG. 3 a heater assembly for an electrical clothes dryer 10 is shown. A pair of electrical heating elements 26 and 28 are mounted on insulators in the diffuser 20. These elements are standard heating elements and are capable of separate electrical energization. The elements 26 and 28 pass through insulators such as those shown at 30 in the diffuser 20. The diffuser is made to mate with the revolving drum so that there is good communication between the drum and the diffuser for the hot air steam.

A thermally biased temperature sensor or thermostat 34 is shown mounted on the side of the diffuser 20 for the gas dryer shown in FIG. 3 and on the top of the electric dryer as shown in FIG. 2. This thermostat 34 is designed to open before the temperature of the air entering the clothes drum reaches a temperature that might damage the clothes being dried. A second temperature sensor or thermostat 36, located in both FIGS. 2 and 3 adjacent thermostat 34, has a higher temperature rating and is generally regarded as an ultimate safety thermostat rather than a controlling thermostat.

Referring to FIG. 1, an additional thermally biased temperature sensor or thermostat 40 is located at or near the front of the cabinet so as to monitor the temperature of the air stream as it leaves the rotating drum. Temperature sensor 40 controls the drying process.

A housing 44 is mounted so as to be in airflow communication with drum 20 via the air flow outlet of the drum. A lint filter 45 is shown for trapping lint just as the air enters housing 44. Air is drawn from housing 44 into blower housing 46 by a blower in housing 46 driven by motor 47. The air leaving blower housing 46 exits the dryer via pipe or duct 48.

Referring to FIGS. 4 to 7 the basic control circuit of the present invention in relation to a gas clothes dryer is shown. Power is fed to terminal 50 designated as $L_1$. The neutral terminal is shown at 59. Terminal 50 is connected to one pole 56 of timer motor control switches 58 and 53. The terminal 54 of switch 53 is connected to terminal 57 of selector switch 15. The other pole 61 for terminal 57 in switch 62 of selector switch 15 is connected to pole 74 of thermally biased thermostat 40 located on the outlet air stream side of the dryer drum.

The biased thermostat 40 is provided with a resistor heating element 41 connected across terminal 102 of centrifugal switch 104 and terminal 78 of switch 80 of selector switch controller 15. Switch 80 has a pole 82 connected to pole 84 of switch 86. The other pole 88 of switch 86 is connected to biasing resistor 90 of thermally biased thermostat 34. Thermostat 34 has a terminal 91 connected to the resistor 90. Thermostat 34 has a terminal 94 connected to gas burner 21 to the flame detector 242, in series with ignitor 244. Also terminal 94 is connected to one side of main coil 246 and safety coil 248 of burner 21.

Thermostat 40 is connected at pole 74 via trimmer thermostat 32 to bias resistor 90 of thermostat 34. Trimmer thermostat 32 is located adjacent the gas burner 21 in FIG. 2. Pole 76 of thermostat 40 is connected via safety thermostat 36 to one side of burner 21 at ignitor 244, booster coil 240 and safety coil 248. The main coil 246 and booster coil 240 are connected at terminal 250 to terminal 252 of switch 254. The other pole 256 of switch 254 is also a pole of switch 260. The other pole of switch 260 is connected to pole 102 of motor centrifugal switch 104. Pole 256 is connected to timer motor 108.

Dryer air exhaust system indicator lamp 200 is connected across poles 70 and 72 of the safety thermostat 36. Thermostat 36 is calibrated so that it trips to "open position" only when abnormal blockage of air flow exists. When it trips, indicator lamp 200 lights up to indicate to a user that the dryer air flow is abnormally restricted and that filter or exhaust system of dryer should be verified and cleaned.

Terminal 60 of timer control switch 58 is connected to timer motor 108 and to terminal 64 of motor start switch 66.

Pole 68 of start switch 66 is connected to pole 116 of centrifugal switch 110 which in turn is connected to "run" winding 118 of the blower and drum drive motor 47 shown in FIG. 1. The other end of run winding 118 is connected to terminal 114 which is connected to terminal 120 of switch 122. The other terminal 124 of switch 122 is connected to neutral terminal 59.

Pole 64 of start switch 66 is connected to pole 126 via poles 107 and 111 of switch 109. The blade 126 of centrifugal switch 110 is shown in its "start" position, i.e. bridging poles 116 and 128. Pole 128 is connected to "start" winding 130 of motor 47. The other end of start winding 130 is connected to terminal 114 which is connected to terminal 120 of door switch 122 and also connected to terminal 106 of motor centrifugal switch 104.

Basically the circuit functions as follows: Control timer is set by the operator to a setting calculated to give a predetermined desired degree of "dryness" to the clothes in dryer drum 18 at the end of the drying cycle. The other variable set by the operator is the dry air temperature at selector switch 15. With the control timer switch set to dry, the switches 53 and 58 are closed. Therefore contacts 56 and 60 plus contacts 56 and 54 are closed, and, with air temperature selected (switch 15), the operator depresses the "start" button on switch 66 and the windings 118 and 130 are energized and motor 47 begins to run. As the motor gains speed centrifugal switches 104 and 110 snap to the alternate state closing contacts 116, 126, 102 and 106. The operator may now allow the start switch 66 to return to its unabridged position opening contacts 64 and 68. Run winding 118 is now energized through idler spring switch 109 and switch blade 126 of switch 110. Idler spring switch is closed when the belt, driving the drum from motor drive pulley, is in place. If this belt breaks, switch 109 opens and motor stops turning.

Similarly, current for the burner 21 is supplied via temperature switch 15, safety thermostat 36 (located on diffuser), and drum outlet thermostat 40. It will be noted that thermostat 34 carries current from switch 102 to main coil 246, flame detector 242 and safety coil 248.

For regular timed dry cycle, switch 260 is closed, contacts 256 and 258 are closed and timer motor run until contact 54 and 56 of switch 53 open and de-energize the burner circuit. A few minutes later, contacts 56 and 60 of switch 58 opens and stop main motor 47 and timer motor 118. For automatic dry cycle, the timer motor will not advance as long as the gas heater or burner 21 is energized because switch 260 is open, contacts 256 and 252 of switch 254 are closed, flame detector switch 242 is open and thereby, timer motor 108 is in series with the gas valve main coil 246 which has a high impedance. Also, in that position, through burner circuit $L_1$ voltage is maintained at ignitor 244, at terminal 250 and at other side of timer motor 108.

As the clothes begin to dry, the temperature of the air exiting the drum begins to increase and thermostat 40 controls the energization of the valve main coil 246 (through low resistance ignitor 244) and safety coil 248.

The gas dryer has five basic temperature control settings which are referred to as high heat, medium heat, low heat, damp dry and fluff. The selector switch 15 is set to meet these five temperature settings and the contact settings for these temperature settings are shown respectively in FIGS. 4, 5, 6 and 7. For the fluff temperature setting the terminals 57 and 61 of contact 62 of temperature switch 15 are open.

Figure 4:
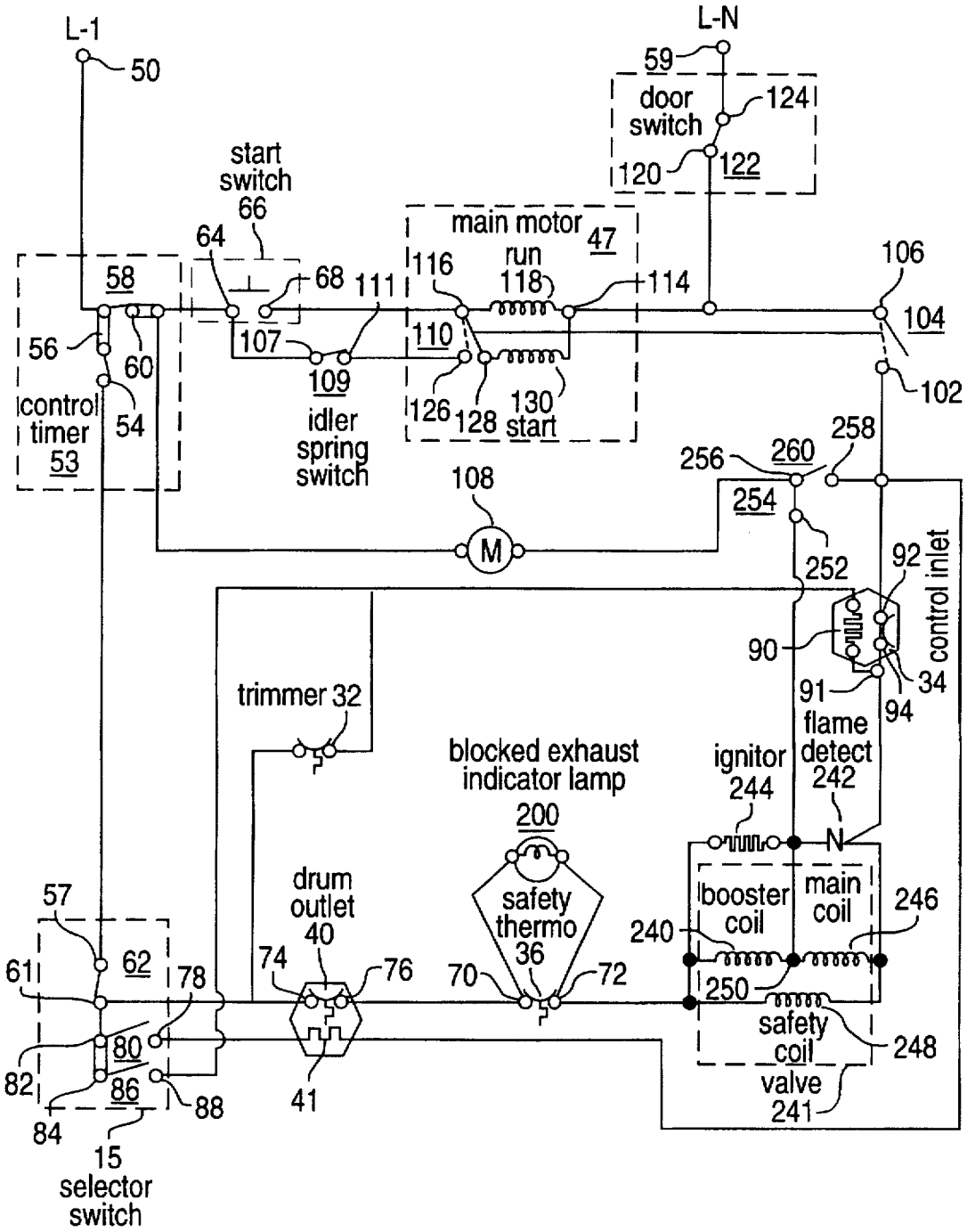
FIGS. 4, 5, 6 and 7 are circuit diagrams utilized by gas dryer of FIGS. 1 and 2 showing the various contact positions respectively for high heat, medium heat, low heat and damped heat operation; and, FIGS. 8, 9, 10 and 11 are circuit diagrams utilized by the electric dryer of FIGS. 1 and 3 showing the various contact positions respectively for high heat, medium heat, low heat and damped heat operation.

Referring to FIG. 4 there is shown the high heat temperature condition wherein the contact or switch 62 is closed so that there is a contact across terminals 57 and 61. Switches 86 and 80 remain open. In this high heat condition, a circuit path is provided through thermostat 40 and 36 and also through trimmer thermostat 32 to bias resistor 90 of thermostat 34.

The purpose of trimmer thermostat 32 which is located on the diffuser plate just downstream of the combustion chamber or burner 21 is such that this trimmer thermostat 32 is calibrated so that it will stay closed for the first 2 to 4 minutes during the heating cycle. During this time the internal heater 90 of the inlet control bias thermostat 94 will heat up to offset the thermal inertia of thermostat 34. This will prevent thermostat 34 from overshooting its temperature of air entering the drum. The air entering the drum typically will result in an overshoot of temperature when larger loads are placed in the drum or there are restrictions in the drum or in the airflow through the dryer. Temperature overshooting will have a less effect when there is good air flow through the dryer drum.

In this cycle, the ignitor 244 is energized and gets red hot. When this is detected by the flame detector, (the flame detector will open when it is hot enough), the detector, de-energizes the ignitor and energizes the main valve coil 246. The booster and safety coils are energized at the same time as the ignitor coil. As the main valve opens, gas will flow. The gas hits the hot ignitor and ignites into flame. This flame will keep the flame detector open. The burner 21 then heats the air in the air stream which enters the air inlets of the dryer drum. With good air flow the inlet control thermostat will not open and neither will the safety thermostat. As the clothes dry, air coming out of the drum gets hotter and reaches the point where the outlet thermostat 40 opens and cuts off the gas valve and flame. As thermostat 40 cools down it resets and restarts the heating process until the timer runs out.

A problem can occur when the air flow is restricted or larger loads are placed in the dryer drum. This will result in less air flow through the drum and the air entering the drum air inlet will get hotter quicker. The purpose of the air inlet thermostat 34 is to cycle on and off to prevent excessive air temperature at drum inlet. Because the trimmer thermostat remains on for the first 2 to 4 minutes of the cycle, it allows heater 90 of thermostat 92 to heat up initially during the initial heating phase. This will prevent over heating of the clothes in the dryer drum in the event there is a blockage. The trimmer thermostat 32 prevents over heating by a slow heating of thermostat 34 (because of its mass and the time required to heat it), in the first thermostat opening cycle when dryer is started from a cold condition. It should be understood that burning of the gas in a gas dryer can result in a quick rise in the temperature of the air flow stream. After the first cycle, the inlet thermostat has warmed up and it will keep cycling to prevent over heating and hence at this time the trimmer thermostat 32 opens. Consequently, there is no longer a biasing of resistor 90 in thermostat 34 by the trimmer thermostat 32. As the clothes dry, the outlet control thermostat 40 will start to cycle on and off. When this thermostat opens and in the automatic cycle the timer will advance and this will go on until the timer runs down and cools off the clothes. The lower the air flow, the faster the inlet control thermostat 34 will cycle open and closed reducing the energization of the burner 21 so that the heating rate of the burner 21 is reduced during dryer operation.

Figure 5:
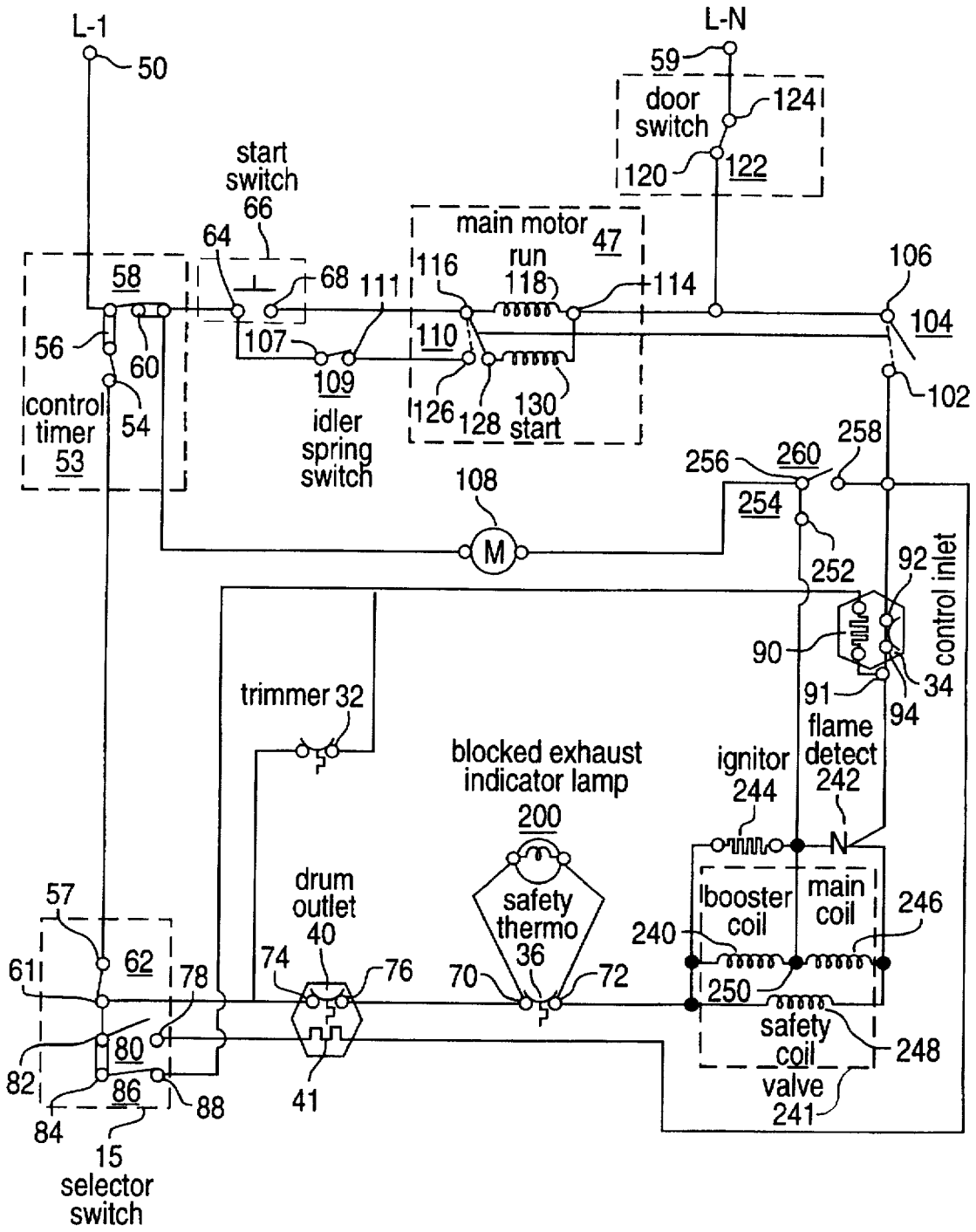

Referring to FIG. 5 there is shown the medium heat selection of selector switch 15. In this condition contact switch 62 is closed and contact switch 86 is closed. In this condition, the trimmer thermostat 32 is of no use as resistor 90 is energized directly from switch 86. The operation of the medium heat condition will operate much the same as the high heat condition shown in FIG. 4. However because the selector switch 15 has contact switch 86 closed, there will be a continuous energization of the bias resistor heating element 90 of thermostat 34. Consequently the biased inlet control thermostat 34 will start cycling sooner and quicker through its cycles. This will keep the air entering the drum at a lower temperature.

Figure 6:
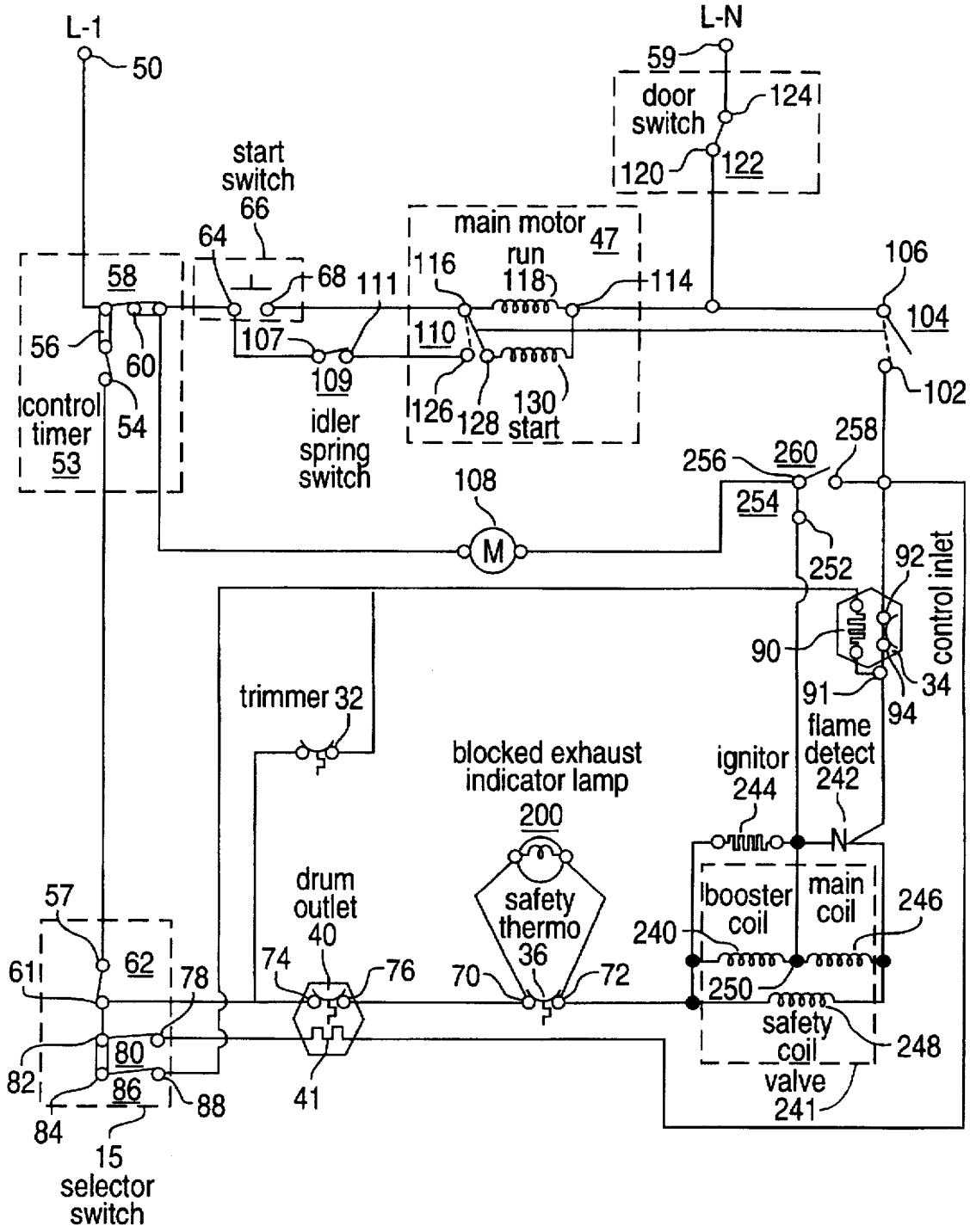

Referring now to FIG. 6, there is shown the selector switch combination for a low heat condition. In this situation the contacts switches 62, 86 and 80 are all shown in a closed position. This circuit will work similar to that described for the medium heat circuit shown in FIG. 5 except that the resistor 41 of the outlet biased thermostat 40 is energized. This will make the drum outlet thermostat start to cycle sooner during the drying cycle. The advantage of this is that both the temperatures at the dryer drum inlet and the dryer drum outlet are monitored at a lower level to satisfy the low heat setting selected and accordingly the heat entering the dryer and the heat leaving the dryer drum will be at a lower rate during the entire drying cycle.

Figure 7:
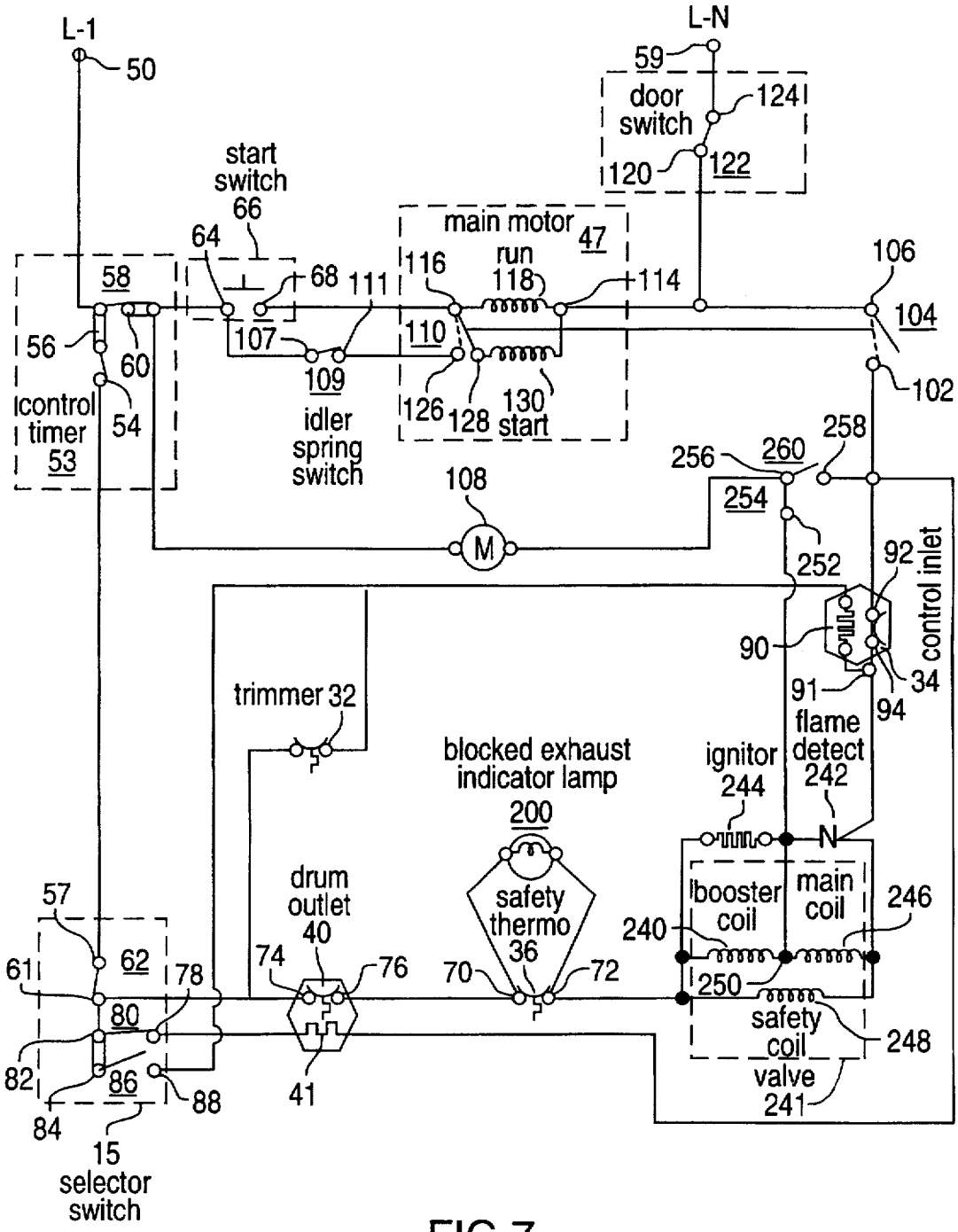

Referring now to FIG. 7 there is shown the damp dry selection for the selector switch 15 wherein contacts which 62 is closed, contact switch 86 is open and contact switch 80 is closed. The circuit shown in this selection for selector switch 15 will operate in much the same fashion as the high heat circuit shown in FIG. 4. Except that the selector switch 80 is closed and as a result the drum outlet thermostat 40 will trip sooner and its cycling will advance the timer to the off position before the clothes are fully dry allowing them to be damp dried.

Referring to FIGS. 8 to 11 the basic control circuit of the present invention in relation to an electric clothes dryer is shown. Circuit components shown in these Figures having the same function as circuit components in FIGS. 4 to 7 bear the same numerical designations. Power is fed to the two terminals 50 and 52 designated as $L_1$ and $L_2$ respectively. The neutral terminal is shown at 59. Terminal 50 is connected to one pole 56 of timer control switch 53 and 58. The terminal 54 of switch 53 is connected to terminal 57 of temperature selector switch 15. The other pole 61 for terminal 57 in switch 62 of selector switch 15 is connected to a first pole 70 of safety thermostat 36. The function of thermostat 36 is to cut power to the dryer heating coils 26, 28 in the event the dryer overheats above safe temperatures. The other pole 72 of safety thermostat is connected to pole 74 of thermally biased thermostat 40 located on the outlet air stream side of the dryer drum.

The biased thermostat 40 is provided with a resistor heating element 41 connected across terminal 76 of the thermostat 40 and terminal 78 of switch 80 of selector switch 15. Switch 80 has a pole 82 connected to pole 84 of switch 86. The other pole 88 of switch 86 is connected to biasing resistor 90 of thermally biased thermostat 34. Thermostat 34 has a terminal 92 connected to the biasing resistor 90 and outer heating coil 26 of the electrical heating device for the electric clothes dryer. The other terminal 94 of thermostat 34 is connected to pole 76 of thermostat 40, to resistor 98 and to one side of inner heating coil 28 of the electrical heating device. Inner electric heating coil 28 and outer electric heating coil 26 of the electrical heater are connected at 100 to pole 102 of centrifugal switch 104. The other pole 106 of centrifugal switch 104 is connected to line terminal 52.

Terminal 60 of motor controlled switch 58 is connected to timer motor 108. The other pole of timer motor 108 is connected to terminal 103, and to pole 256 of switch 260. The other pole 256 of switch 260 is connected to neutral terminal 59. Also connected to neutral terminal 59 are poles 82 and 84 respectively of switches 80 and 86 of switch controller 15.

Pole 68 of start switch 66 is connected to pole 116 of motor centrifugal switch 110 which in turn is connected to "run" winding 118 of the drum and blower drive motor 47 shown in FIG. 1. The other end of run winding 118 is connected to terminal 114 which is connected to terminal 120 of switch 122. The other terminal 124 of switch 122 is connected to neutral terminal 59.

The blade of centrifugal switch 110 is shown in its "start" position, i.e. bridging poles 116 and 128. Pole 128 is connected to "start" winding 130 of motor 47. The other end of start winding 130 is connected to terminal 114 which is connected to terminal 120 of door switch 122. The other terminal 124 of door switch 120 is connected to neutral terminal 59.

Basically the circuit functions as follows: Control timer is set by the operator to a setting calculated to give a predetermined desired degree of "dryness" to the clothes in dryer drum 18 at the end of the drying cycle. The other variable set by the operator is the temperature of drying cycle at selector switch 15. With the control timer set, switches 53 and 58 are closed, and control temperature selected, the operator depresses the "start" button on switch 66 and the windings 118 and 130 are energized and motor 47 begins to run. As the motor gains speed centrifugal switches 104 and 110 snap to the alternate state closing contacts 116, 126 and 102 and 106. The operator may now allow the start switch 66 to return to its unabridged position opening contacts 64 and 68. Run winding 118 is now energized through high limit thermostat 132 and switch blade 126 of switch 110.

Similarly, current for the two heating elements 26 and 28 is supplied via control timer, switch 53, selector switch 15, safety thermostat 36 (located on diffuser), drum outlet temperature thermostat 40 to inner coil 26 and inlet drum temperature thermostat 34 to outer coil 26.

For regular timed dry cycle, switch 260 is closed, contacts 256 and 258 are closed and timer motor run until contact 54 and 56 of switch 53 open and de-energize the heater circuit. A few minutes later, contacts 56 and 60 of switch 58 opens and stop main motor 47 and timer motor 108.

For automatic dry cycle, the timer motor will not advance as long as the inner heater coil 28 is energized from $L_1$ because resistor 98 maintains a potential of $L_1$ on terminal 103.

As the clothes begin to dry, the temperature of the air exiting the drum begins to increase and dryer outlet thermostat 40 controls the energization of coils 26 and 28. When either the safety thermostat 36 or the drum outlet thermostat 40 opens, resistor 98 is then fed to the $L_2$ potential through low resistance inner heater coil 28 and timer motor runs.

The electric clothes dryer is capable of five heat settings using the selector switch 15. The five heat settings are high heat, medium heat, low heat, damp dry and fluff. The contact switches are shown for each of these five heat settings respectively in FIGS. 8 through 11. For the fluff temperature, switch 62 is open and heater is not energized.

Figure 8:
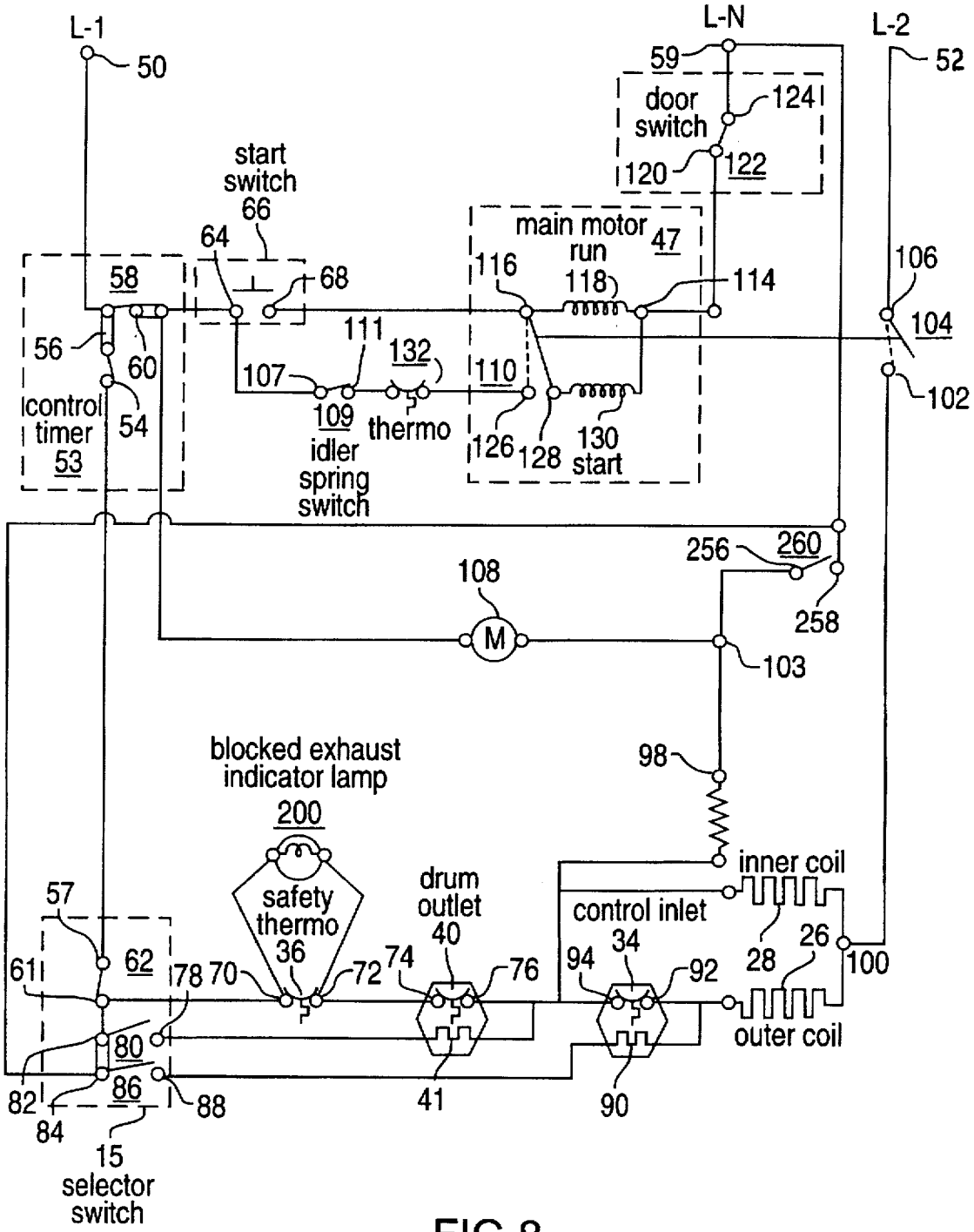

In the high heat setting of FIG. 8, the switch 62 is closed completing a circuit path through contact poles 57 and 61. Switches 80 and 86 are open. Consequently, a circuit path through switch 62, safety thermostat 36, thermostat 40 is provided to the inner and outer coils. Further, the circuit to the outer coil is provided through thermostat 34. The high heat setting is useful for when general mixed fabrics are in the dryer drum. Both the inner and outer heater coils 26 and 28 are energized and the dryer heats up and dries the clothes. With good air flow, the inlet control thermostat 34 will not open, neither will the safety thermostat 36. As the clothes dry, air coming out of the drum gets warmer and warmer and reaches a predetermined temperature where the outlet thermostat 40 opens and cuts off power to the heater coils. It then cools down and resets the heating process till the timer runs to cool down the load and reaches the off position.

When larger loads are in the dryer or there is a restriction in the exhaust stream then both heater coils 26 and 28 will be energized and the air flow passing over these coils in the diffuser will be reduced. The air entering the drum will get hotter at the drum inlet causing thermostat 34 to open and cut the outer coil 26 out of the heating loop. This will prevent the clothes in the dryer from over heating. As the clothes get dryer the outlet control thermostat will also start to cycle on and off as the temperature sensed by the outlet control thermostat 40 will reach its temperature setting. When this outlet thermostat 40 opens in automatic cycles the timer advances and the main motor will continue to run and rotate the drum as the clothes cool down and the timer motor 108 will turn off the dryer.

Figure 9:
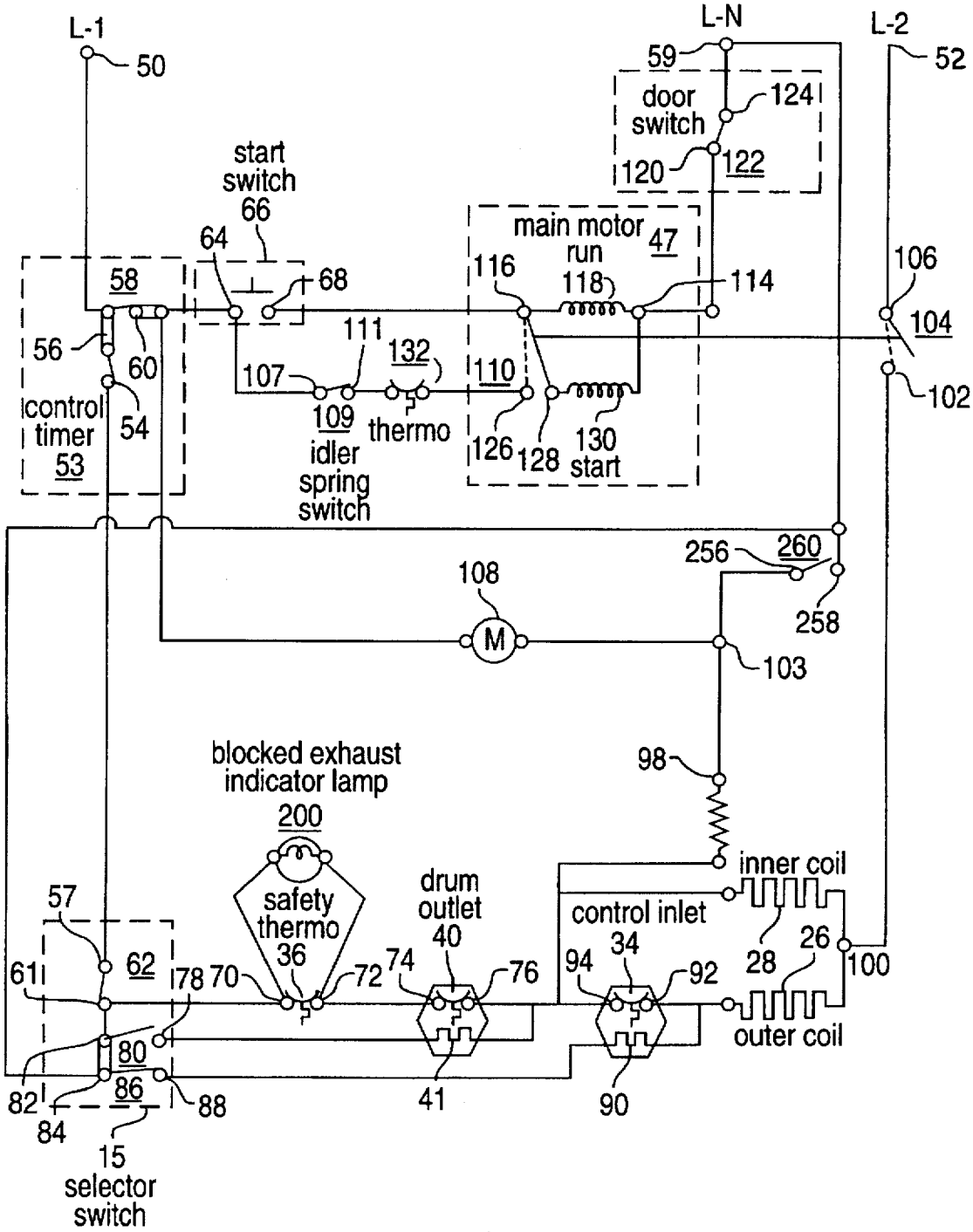

Referring to FIG. 9, the same circuit as FIG. 8 is shown except the switch contacts for the selector switch 15 are different. In the medium heat position shown in FIG. 9, contacts 57 and 61 of switch 62 are closed, contacts 82 and 78 of switch 80 are open, and contacts 84 and 88 of switch 86 are closed. The cycling of the clothes dryer to heat the clothes within the drum will be the same for the most part as described herein before for FIG. 8. The only difference will be that due to the fact that contacts 84 and 88 of switch 86 are closed, this results in bias heater 90 of bias thermostat 34 being heated. Consequently, this reduces the temperature setting at which bias thermostat 34 will cycle open and closed. Consequently the cycling of the inlet dryer air flow biasing thermostat will cycle faster and as a result the outer heating coil 26 will be removed from the dryer circuit more often keeping the temperature entering the dryer drum at a lower temperature.

Figure 10:
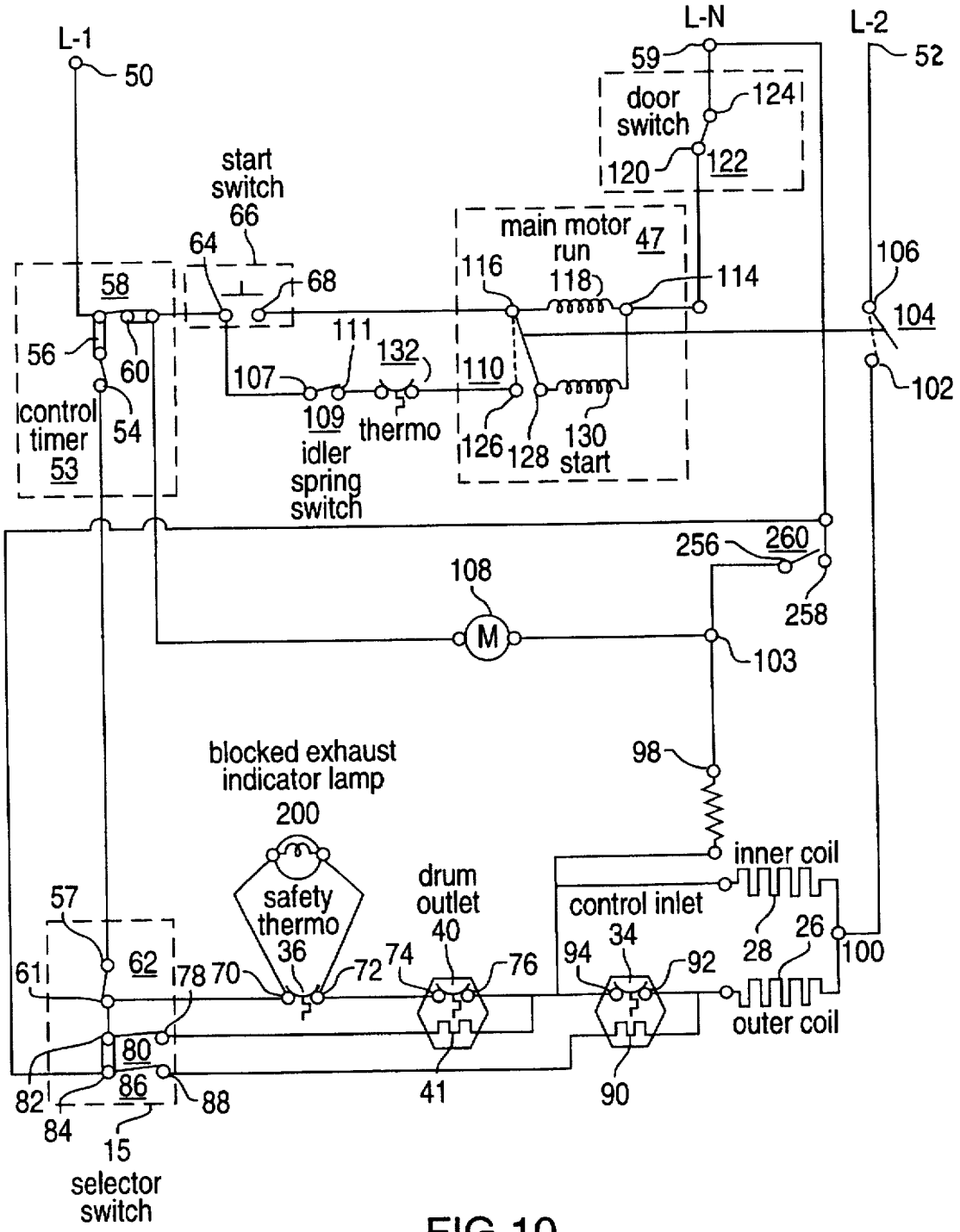

Referring to FIG. 10, the low heat cycle is shown for the selector switch 15 which shows each of the contact switches 62, 80 and 86 being closed across their respective terminals. With respect to switches 62 and 86 being closed as in FIG. 9, the circuit works as it would in the medium heat position except that the thermally bias outlet thermostat is now biased with its internal heating resistor 41 being energized. This makes the outlet drum thermostat start to cycle at a reduced temperature and as a result the drying cycle starts to cycle sooner. The advantage of this system is that both temperatures at the drum inlet and the drum outlet are moderate and lowered to satisfy the low heat setting selected.

Figure 11:
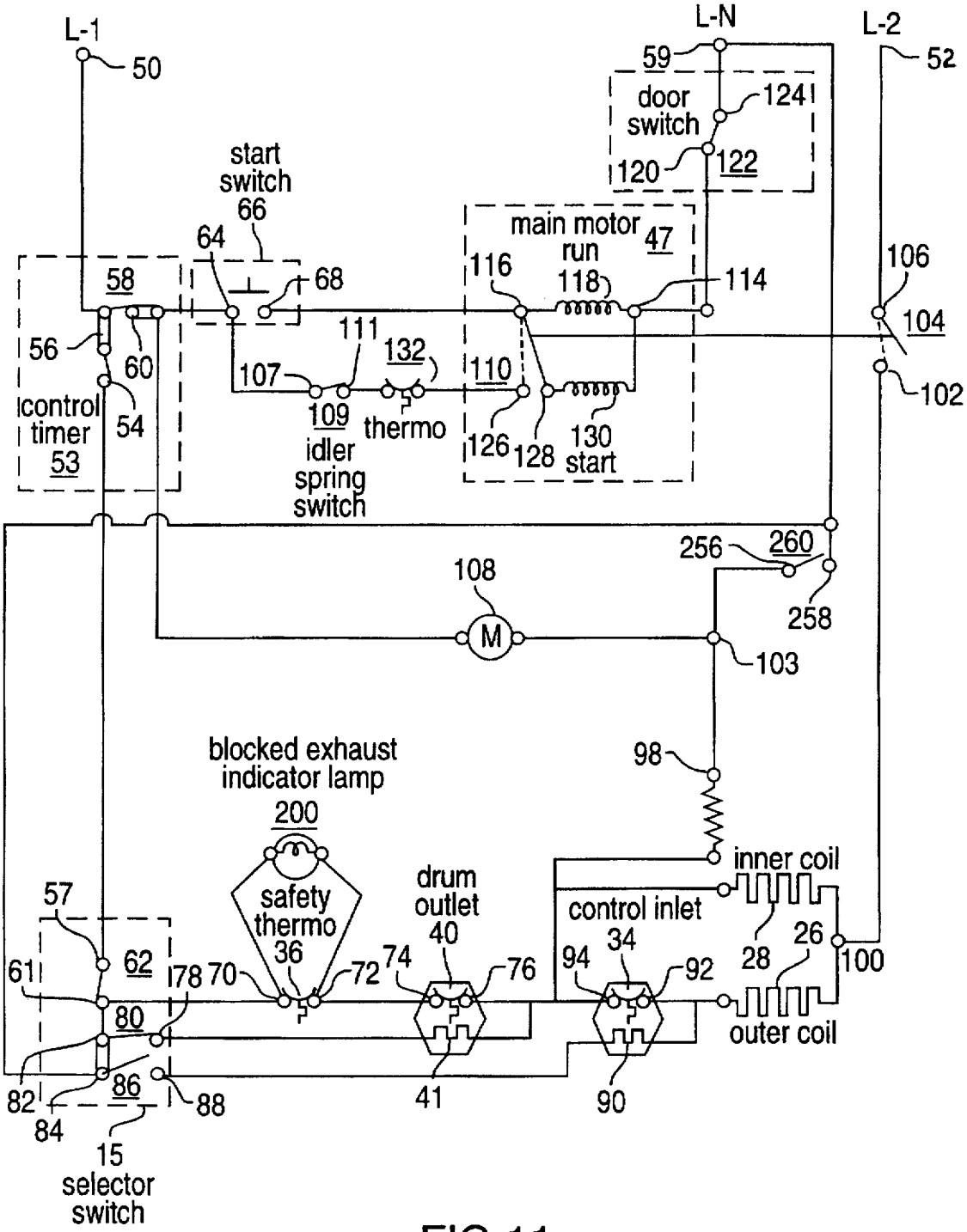

Referring to FIG. 11, the damp dry temperature selection for selector switch 15 is shown. In this setting the switches 62 and 80 are closed and switch 86 remains open. This selection works the same as the high heat selection of FIG. 8 except that the switch 86 is closed. As a result drum outlet thermostat is biased across resistor 41 and trips sooner in the cycle. This will allow the timer motor 108 to advance quicker to the off position before the clothes are fully dried and a damp dried cycle is obtained.

Accordingly, the use of the thermally biased thermostats 40 and 34 of the present invention located respectively at the air outlet of the dryer drum and air inlet of the dryer drum allows for the use of a five position selector switch 15 to provide five dryer settings.

Various alternatives will be obvious to those skilled in the art, but applicant wishes to be limited only the scope of the following claims.

I claim:

1. A control circuit for operating a clothes dryer having a dryer drum, a drum air inlet and a drum air outlet permitting an air stream to pass through the dryer drum, and a heating device for heating the air stream before the air stream passes through the dryer drum, the control circuit comprising:

a first thermally biased thermostat mounted in the dryer between the heating device and the drum air inlet and being electrically connected in series with the heating device, the first thermally biased thermostat being responsive to temperature of the air stream prior to the air stream passing through the dryer drum to move between open and closed positions for controlling corresponding heating and non-heating operation of the heating device, the thermally biased thermostat including a first heat biasing resistor which when energized alters thermal response of the first thermally biased thermostat;

a switch temperature controller mounted to the dryer for controlling operation of the dryer, the switch controller having at least one dryer operation position corresponding to a heat setting temperature below maximum temperature setting that initiates and maintains the heating operation of the heating device and causes electricity to flow through a circuit path that energizes the first heat biasing resistor of the thermostat, the first heat biasing resistor continually heating the first thermally biased thermostat to reduce said heat setting temperature blow said maximum temperature setting at which the first thermally biased thermostat cycles on an off to reduce the temperature of the air stream entering the dryer drum through drum air inlet.

2. A control circuit for operating a clothes dryer as claimed in claim 1 further including a second thermally biased thermostat mounted in the dryer adjacent the dryer drum air outlet and being electrically connected in the series with the heated device, the second thermally biased thermostat being responsive to the temperature to the air stream exiting the dryer drum to move between open and closed positions for controlling corresponding heating and non-heating operation of the heating device, the second thermally biased thermostat including a second heat biasing resistor which when energized alters the thermal response of the second thermally biased thermostat.

3. The control circuit for operating a clothes dryer as claimed in claim 1 wherein the heating devices comprises a gas burner.

4. The control circuit for operating a clothes dryer of claim 3 wherein the thermostat of the first thermally biased thermostat is connected in series with the trimmer thermostat, the switch temperature controller including three switches, a first switch for energizing the first thermally biased thermostat so as to energize the heating device and the trimmer thermostat, a second switch contact for energizing the second thermal resistor of the second thermally biased heating device and a third switch contact for energizing the first thermal biasing resistor of the first thermostat device whereby closing of the first contact switch device of the switch controller provides a high heat condition, closing of the first contact and the second contact of the switch device provides a medium heat condition, closing of all three contacts provides for a low heat condition and closing of the first contact and the third contact providing for a damp dry heat condition.

5. The control circuit of claim 1 wherein the trimmer circuit is replaced by a resistor which provides a potential divider for allowing the reduced biasing of the first thermally biased resistor or the second thermally biased thermostat.

6. The control circuit for operating a clothes dryer as claimed in claim 1 further including a blocked air flow indicator lamp connected across a safety thermostat which allows for a lamp indication to light up when the safety thermostat opens.

7. A control circuit for operating a clothes dryer having a dryer drum, a drum air inlet and a drum air outlet permitting an air stream to pass through the dryer drum, and a heating device for heating the air stream before the air stream passes through the dryer drum, the control circuit comprising:

a first thermally biased thermostat mounted in the dryer between the heating device and the drum air inlet and being electrically connected in series with the heating device, the first thermally biased thermostat being responsive to temperature of the air stream prior to the air stream passing through the dryer drum to move between open and closed positions for controlling corresponding heating and non-heating operation of the heating device, the thermally biased thermostat including a first heat biasing resistor which when energized alters thermal response of the first thermally biased thermostat;

a trimmer thermostat mounted in the air stream downstream of and adjacent the heating device, the trimmer thermostat being electrically connected in series with the first heat biasing resistor, the trimmer thermostat being responsive to the temperature of the air stream flowing from the heating device to move between an initially closed position enabling electrical energization of the first heat biasing resistor and an open position inhibiting electrical energization of the first heat biasing resistor; and, a switch temperature controller mounted to the dryer for controlling operation of the dryer, the switch controller having at least one dryer start-up position that initiates the heating operation of the heating device and causes electricity to flow through a circuit path including the trimmer thermostat to electrically energize the first heat biasing resistor causing the first heat biasing resistor to pre-heat the first thermostat prior to the air stream being overly heated to thereby reduce first cycle response time of the first thermally biased thermostat.

8. The control circuit of claim 1 wherein the trimmer thermostat has a calibration that causes the thermostat to open at a predetermined temperature.

9. A control circuit for operating a clothes dryer as claimed in claim 1 further including a second thermally biased thermostat mounted in the dryer adjacent the dryer drum air outlet and being electrically connected in series with the heated device, the second thermally biased thermostat being responsive to the temperature to the air stream exiting the dryer drum to move between open and closed positions for controlling corresponding heating and non-heating operation of the heating device, the second thermally biased thermostat including a second heat biasing resistor which when energized alters the thermal response of the second thermally biased thermostat.

10. The control circuit for operating a clothes dryer as claimed in claim 1 wherein the heating devices comprises a gas burner.

11. The control circuit for operating a clothes dryer of claim 10 wherein the resistor of the first thermally biased thermostat is connected in series with the trimmer thermostat, the switch controller including three switches, a first switch for energizing the first thermally biased thermostat so as to energize the heating device and the trimmer thermostat, a second switch contact for energizing the second thermal resistor of the second thermally biased heating device and a third switch contact for energizing the first thermal biasing resistor of the first thermostat device whereby closing of the first contact switch device of the switch controller provides a high heat condition, closing of the first contact and the second contact of the switch device provides a medium heat condition, closing of all three contacts provides for a low heat condition and closing of the first contact and the third contact providing for a damp dry heat condition.

12. The control circuit for operating a clothes dryer as claimed in claim 7 further including a blocked air flow indicator lamp connected across a safety thermostat which allows for a lamp indication to light up when the safety thermostat opens.

* * * * *